United States Patent [19]

Swenson

[11] 4,185,622

[45] Jan. 29, 1980

[54] FOOT AND LEG EXERCISER

[76] Inventor: Oscar J. Swenson, 630 S. Poplar Way, Denver, Colo. 80224

[21] Appl. No.: 22,470

[22] Filed: Mar. 21, 1979

[51] Int. Cl.[2] ..... A61H 1/02

[52] U.S. Cl. ..... 128/25 B

[58] Field of Search ..... 128/25 R, 25 B, 49

[56] References Cited

U.S. PATENT DOCUMENTS

| | | | |
|---|---|---|---|
| 1,709,410 | 4/1929 | Simmons | 128/25 B |
| 2,139,166 | 12/1938 | Leuchter | 128/25 B |
| 3,316,898 | 5/1967 | Brown | 128/25 B |
| 3,370,584 | 2/1968 | Girten | 128/25 B |
| 3,419,001 | 12/1968 | Woods | 128/25 B |
| 3,540,436 | 11/1970 | Hueftle | 128/25 B |
| 3,742,940 | 7/1973 | Phiffer | 128/25 B |
| 3,774,597 | 11/1973 | Root | 128/25 B |
| 3,917,261 | 11/1975 | Small et al. | 128/25 B |

FOREIGN PATENT DOCUMENTS

| | | | |
|---|---|---|---|
| 2613533 | 10/1977 | Fed. Rep. of Germany | 128/25 B |

*Primary Examiner*—Lawrence W. Trapp
*Attorney, Agent, or Firm*—G. W. Swenson, Jr.

[57] ABSTRACT

A foot and leg exerciser comprises an inclinable base, at least one foot pad for supporting and moving the foot of the user, and means for moving the foot pads in a pattern to provide mild exercise which simulates normal walking. The heel ends of the foot pads are moved in a vertical plane by revolving cranks driven by an electric motor through reduction gears, while the toe ends of the foot pads are supported on adjustable rocker arms. Starting, stopping and speed of the motor are controllable by the user through a remote control box. A number of features of the design are directed to safety in the operation of the exerciser.

11 Claims, 9 Drawing Figures

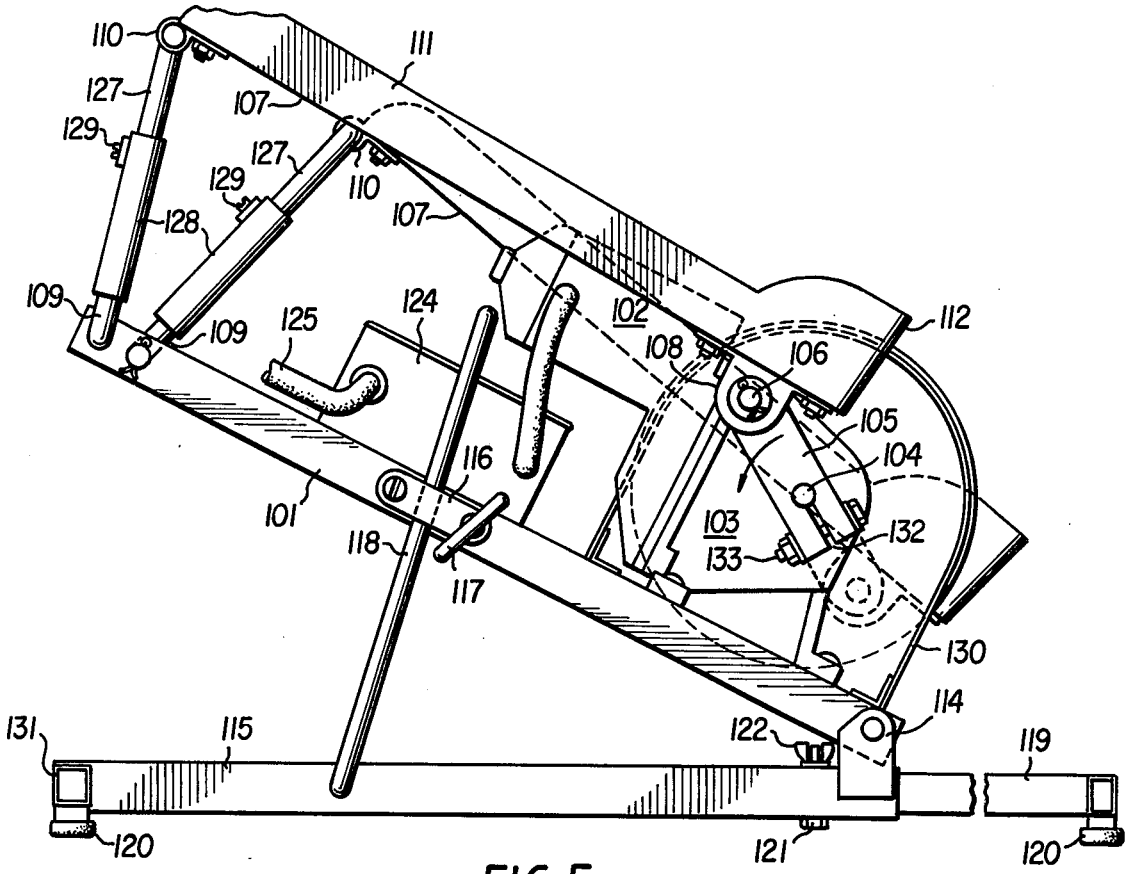
FIG. 5
FIG. 6A
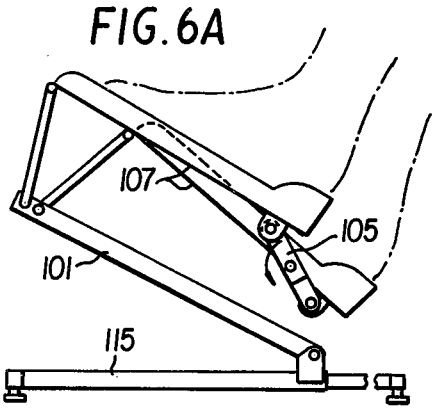
FIG. 6B
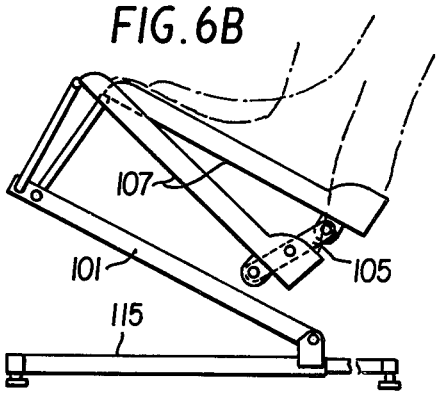
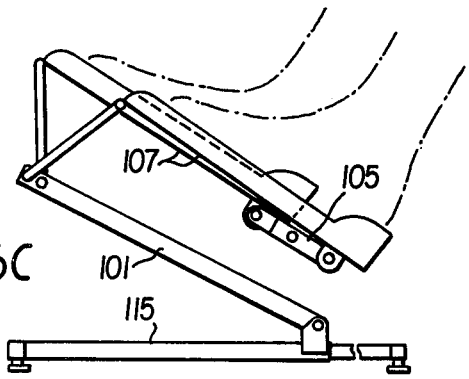
FIG. 6C
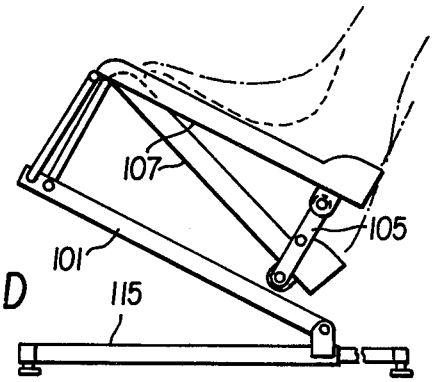
FIG. 6D

FOOT AND LEG EXERCISER

BACKGROUND OF THE INVENTION

1. Field of the Invention

This invention relates to exercising devices and more particularly to foot and leg exercising devices for use by ill or debilitated individuals.

2. Description of the Prior Art

People who are debilitated by reason of illness or age are frequently confined to chairs or beds because they do not have the strength to walk unaided, or at least not for any great distance. As a result, such people are deprived of the opportunity for healthful mild exercise, and their condition becomes even worse because of this lack. This problem has been recognized for a long time, and many mechanical devices have been designed for passively exercising the feet and lower legs of such individuals. The general purpose of such devices is to move the feet and lower legs of the individual to provide the exercise which the person cannot obtain for himself. In some cases an attempt has been made to simulate the actual motion of the legs in walking. This exercise prevents pooling of blood in the lower legs, with its accompanying bad effects on the circulatory system, and prevents the atrophy of the leg muscles. In this way the general health of the individual is promoted, and, if the disability is a temporary one, his convalescence is aided.

The foot and leg exercising machines hitherto proposed, however, have suffered from a number of drawbacks. A number of machines have been designed to provide a rather vigorous type of exercise, resembling riding a bicycle rather than walking. Such machines are apparently intended to be used by people who are in general good health but have lost the use of their legs. While such machines are valuable for their intended use, the exercise they provide is generally too vigorous for people who are ill or aged. Other exercisers have been designed to simulate walking more closely. Devices of this type are disclosed, for example, by Brown, U.S. Pat. No. 3,316,898; Wood, U.S. Pat. No. 3,419,001; Hueftle, U.S. Pat. No. 3,540,436; and Phiffer, U.S. Pat. No. 3,742,940. These machines are, in some cases, rather large and bulky, and incorporate mechanical features which tend to make them difficult to construct and use and may affect their reliability. It also appears that the simulation of waking provided by the hitherto known machines leaves something to be desired.

Hence a need has continued to exist for a simple, inexpensive passive exerciser for the feet and legs of people who have to spend a large portion of the time confined to a chair.

SUMMARY OF THE INVENTION

Accordingly, it is an object of this invention to provide an improved foot and leg exerciser.

A further object is to provide a foot and leg exerciser which simulates the natural motion of the feet and lower legs in walking.

A further object is to provide a compact and reliable foot and leg exerciser.

A further object is to provide a simple and therefore relatively inexpensive foot and leg exerciser.

A further object is to provide a device for exercising the entire lower limb of the body comprising the muscles of the foot, calf, and thigh, and the ankle, knee, and hip joints.

A further object is to provide an exerciser which gently exercises the entire weight-carrying system of the human body.

Further objects will be apparent from the description of the invention which follows.

The objects of the invention are attained by providing a foot and leg exerciser for use by a person desiring such exercise which comprises: a base; at least one foot pad for supporting a foot of a person using the exerciser, the foot pad having a heel end for supporting the heel of the foot and a toe end for supporting the toe of the foot, the heel and toe ends of the foot pad defining a heel-toe axis; a double-ended shaft having its major dimension oriented horizontally and transversely to the heel-toe axis and rotatably journaled in a bearing means mounted on the base, the shaft having at at least one of its ends a crank comprising a crank arm and a crankpin; the heel end of the foot pad being pivotably attached to the crankpin of the crank and the toe end of the foot pad being pivotably supported on the upper end of a rocker arm, the lower end of which is pivotably attached to the base; and means for rotating the shaft in the bearing means.

BRIEF DESCRIPTION OF THE DRAWINGS

A more complete understanding of the invention and its advantages will be obtained by reference to the accompanying drawings wherein the reference numerals refer to the same parts throughout.

FIG. 5 is a side view of the exerciser in a typical operating position.

FIGS. 6A, 6B, 6C, and 6D show the operating cycle of the exerciser.

DETAILED DESCRIPTION OF THE INVENTION

Figure 1:
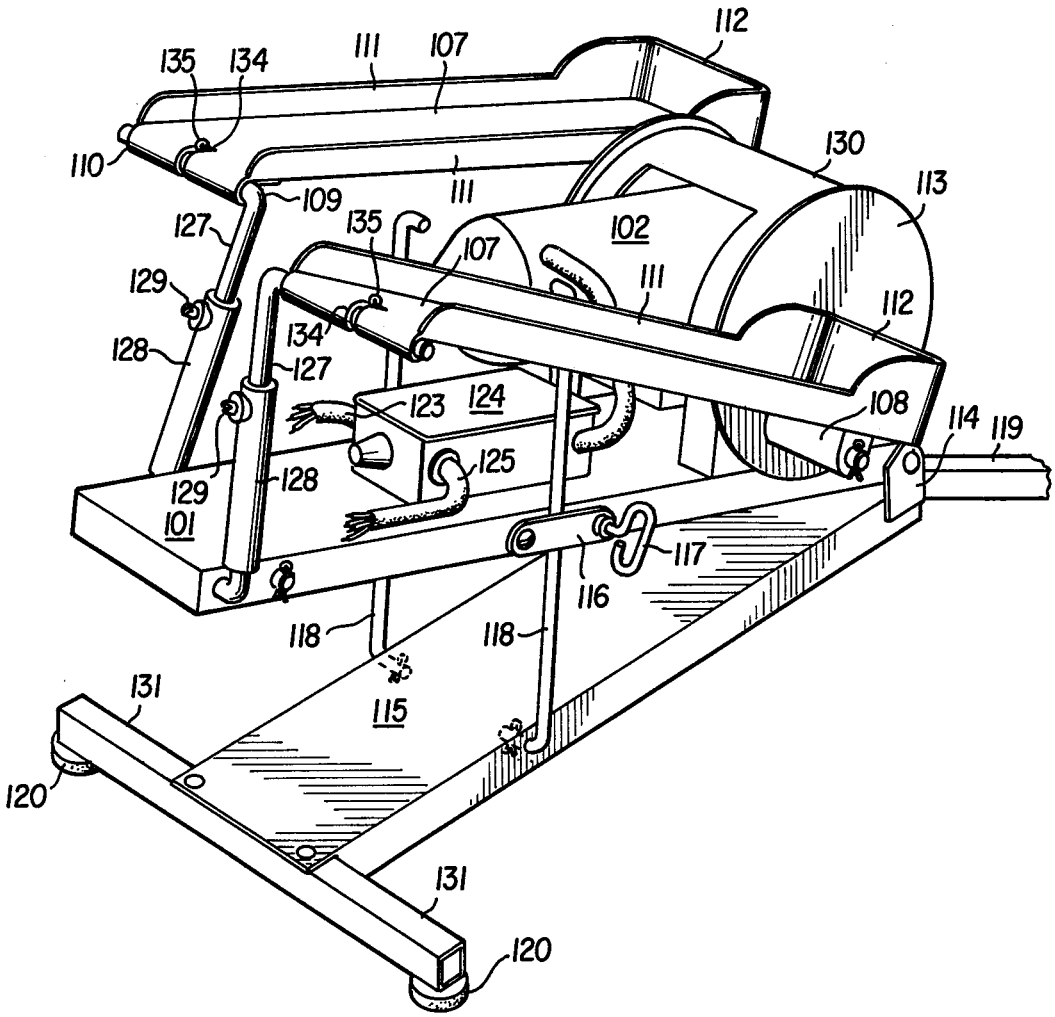
FIG. 1 is a general view of the foot and leg exerciser of this invention.

The invention will now be described in more detail with reference to the drawings.

Referring now to FIGS. 1–5, the embodiment of the invention illustrated therein comprises a base 101, having mounted thereon an electric motor 102 with attached gear housing 103 which contains speed reduction gears. The gear housing 103 also contains bearing means in which is journaled a crankshaft 104, the ends of which protrude transversely from the gear housing 103. At at least one end of the crankshaft 104 is mounted a crank arm 105 which extends at right angles to the crankshaft 104. The crank arm 105 carries a crankpin 106 which extends from the crank arm 105 in a direction parallel to the crankshaft 104. The crank arms 105 and crankpins 106 thus constitute cranks affixed to either end of the crankshaft 104. The cranks are preferably oriented so that the crankpins are in a single plane which also contains the crankshaft 104 and are located 180° from one another in rotation. At least one foot pad 107 for supporting a foot of a person using the exerciser and having a heel end and a toe end for supporting the heel and toe respectively of the user's foot is pivotably mounted on the crankpin 106 by means of the bearing 108, located at the heel end of the foot pad 107. The heel and toe ends of the foot pad define a heel-toe axis and also define the front and rear of the machine, the front being that portion of the machine toward the toe end of the foot pad, and the rear being that portion of the machine toward the heel end of the foot pad, the toe end of the foot pad 107 is pivotably attached to the upper end of a rocker arm 109 by means of a bearing 110 located at the toe end of the foot pad 107. When the foot pad 107 is made from sheet metal or the like, as in the illustrated embodiment, the bearing 110 is conveniently made by forming the metal to fit around the horizontal portion of the upper part of the rocker arm 109 which is of circular cross-section. The toe end of the foot pad 107 may then be conveniently retained in position by means of cotter pin 135 which fits into a hole drilled in the horizontal portion of the rocker arm 109 and rides in slot 134 in the toe end of the foot pad 107. The lower end of the rocker arm 109 is pivotably attached to the base 101. The foot pads 107 may be provided with side rails 111 and heel rails 112 to prevent the user's feet from slipping off the foot pads. Shield disks 113 and cover 130 are also provided to prevent the user's feet from becoming entangled in the moving mechanism if they should slip off the foot pads.

The base 101 of the foot and leg exerciser is attached by a hinge 114, located at the end of the base 101 nearest the heel ends of the foot pads, that is, at the rear of the machine, to a sub-base 115, which supports the exerciser. Thus, the base 101, and with it the foot pads 107, can be inclined at any desired angle to the sub-base 115 and held in place by means of clamps 116, affixed to the sides of base 101, and supports 118 which extend between the sub-base 115 and the base 101 near the front of the exerciser. The clamps 116 are tightened by means of clamp handle 117. The sub-base 115 is provided with front legs 131 extending laterally at the front end of the sub-base 115 and rear legs 119 extending diagonally to the side and rear at the rear end of the sub-base 115. Pads 120, located at the distal ends of the legs support the exerciser on the floor. The rear legs 119 are preferably removable from the sub-base 115 for easier transportation and storage of the exerciser. In the illustrated embodiment of the exerciser the rear legs 119 are attached to the sub-base 115 by means of a single bolt 121 and wing nut 122 so that they can be quickly and easily removed and installed by hand, without the use of tools.

A flexible electric cord 123 electrically connects a junction box 124 to a source of electric power. The junction box 124 is in turn electrically connected to the motor 102 which drives the crankshaft 104. The junction box 124 is also electrically connected through a flexible electric cord 125 to a control box, not shown, of conventional type which contains a motor speed control of the ordinary commercially available kind and conventional electrical switches by means of which the exerciser can be started and stopped and the speed of rotation of the cranks, and thus the rate of movement of the foot pads 107, can be regulated as desired. The controls on the control box may be operated by the user or by another person who assists the user. All electrical conductors are properly insulated, all exposed metallic parts are grounded, and all electrical circuits are properly fused in accord with good electrical wiring practice in order to ensure that the user and/or operator will be protected from any electrical malfunction.

Since the angle between the base 101 and the sub-base 115 can be easily varied, the position of the foot pads relative to the person using the exerciser can be easily adjusted. FIGS. 1 and 5 show the exerciser adjusted to a position which might be suitable for a person seated in a chair. Means may also be provided, as in the illustrated embodiment, for adjusting the length of the cranks to increase or decrease the range of movement of the foot pads, and also to vary the length of the rocker arms 109 to alter the configuration of movement of the foot pads. In the illustrated embodiment the length of the crank is adjusted by moving the crankpin 106 in the slot 126 in the crank arm 105. The outer portion of the crankpin 106, that portion which engages the bearing 108, has a diameter larger than the width of slot 126 in the crank arm 105. The inner portion of crankpin 106 has a reduced diameter, whereby a shoulder is formed at the juncture of the two portions of the crankpin. This shoulder bears against the outer face of the crank arm 105. The inner portion of the crankpin 106 has a diameter which passes through slot 126 with a suitable clearance and a length which is sufficient to protrude slightly beyond the inner face of the crank arm 105. The protruding inner end of the crankpin 106 is threaded and accepts a flat washer and a nut which engages the threads. When the nut is tightened, the washer bears against the inner face of the crank arm 105 and holds the crankpin 106 securely in position. Thus, by adjusting the radial distance of the crankpin 106 from the crankshaft 104, the distance traveled by the heel ends of the foot pads can be controlled. The length of the rocker arms 109 in the illustrated embodiment of the exerciser can be controlled by adjusting the position of the rod 127 which forms the upper part of rocker arm 109 and slides within sleeve 128 which forms part of the lower portion of rocker arm 109. The rod 127 is held at the desired position within sleeve 128 by tightening setscrew 129. In order to allow for adjusting the position of the crankpin 106, the shield disk 113 is provided with a slot corresponding to the slot 126 in the crank arm 105. Thus, by varying the angle of the hinged base, the radial distance of the crankpin 106 from the crankshaft 104, and the length of the rocker arm 109, a wide range of configurations of foot pad movement can be provided to suit the specific desires and/or needs of the person using the exerciser.

The gear housing 103 and the internal moving parts of the machine are covered by cover 130. Only the minimum space required for free movement of the parts is left between the cover 130 and the shield disk 113. Thus, the shield disks 113 and cover 130 in cooperation prevent the users feet from coming in contact with the moving mechanism of the exerciser.

As shown by the arrow in FIG. 5 the preferred direction of rotation of the cranks is that which causes the foot pads 107 to be moving from the rear to the front of the machine when the pads are in the uppermost position. This motion most nearly simulates the normal walking motion of the user. If desired, however, this motion can be reversed by altering the electrical connections inside the junction box or by an external switch suitably connected to the electric circuits which control the rotation of the motor.

To operate the exerciser to accomplish its purpose of providing mild exercise for the feet and legs, the person to be treated is seated in a chair (which may be a wheel chair) facing the rear end of the machine and close enough to it to enable the person to place a foot on each or at least on one of the foot pads. The inclination of the hinged base is then adjusted to suit the position of the seated person, unless this adjustment has been made previously. The adjustment of the cranks and of the rocker arms should be made previously. The above-mentioned control box is held and the controls thereon operated either by an attendant or by the person being treated. The control box is conveniently equipped with a dial which controls and indicates the relative speed of rotation of the cranks and rate of movement of the foot pads. It is preferable that the start-stop switch be a pushbutton switch which starts the exerciser when it is depressed and stops it when released, thus requiring that the pushbutton be held depressed for continuous operation of the exerciser.

From an analysis of the operation of the foot and leg exerciser of this invention and its cycle as shown in FIGS. 6A through 6D it may be seen that it produces a very natural simulation of a gentle walking motion. As the heel of the foot pad moves forward at the top of its cycle, carried by the crank, it moves downward (FIG. 6A), while the toe of the foot pad remains elevated on its rocker arm. Thus the natural motion of the foot in stepping forward and placing the heel on the ground is simulated. As the heel of the foot pad moves backward at the bottom of the cycle, it rises (FIGS. 6B and 6C), just as the heel rises from the ground at the completion of a step. The toe of the foot is relatively extended as the heel rises, just as it is in normal walking. The heel then reaches the top of the cycle, and the cycle begins again. Because of the relatively short travel of the foot pads during the operation of the foot exerciser, it does not simulate a vigorous walk, but that is not its intention. Rather the foot exerciser of this invention simulates a slow walk with short steps such as a debilitated person might actually take in walking.

Figure 2:
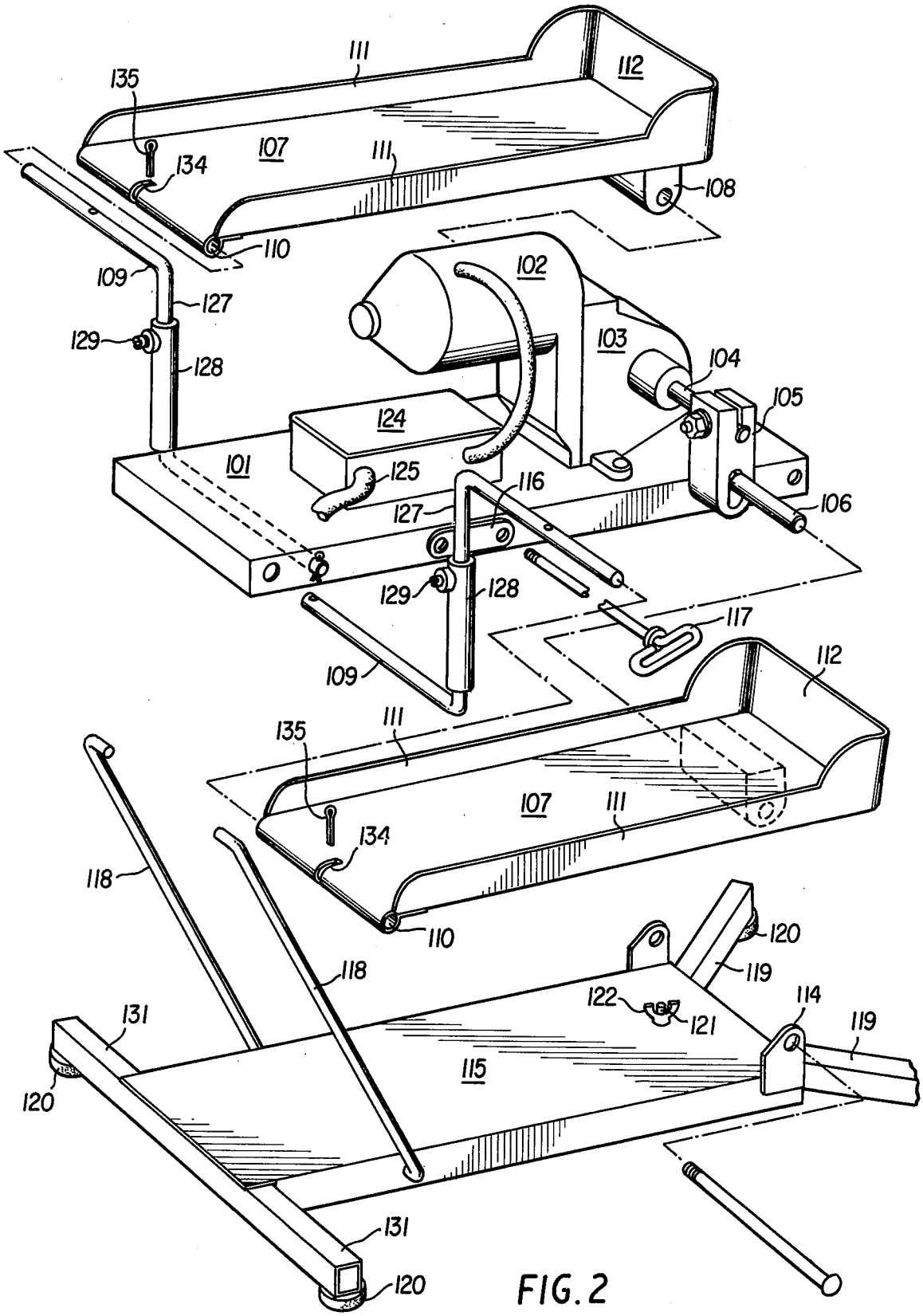
FIG. 2 is an exploded view of the exerciser showing how the principal individual parts are assembled.
Figure 3:
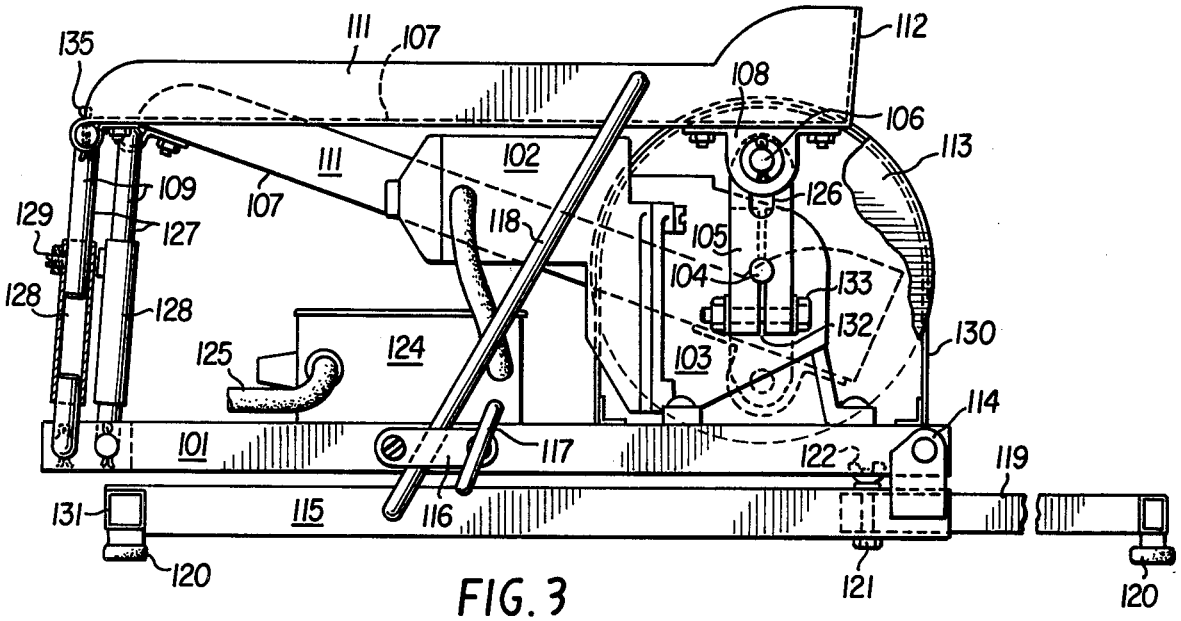
FIG. 3 is a side elevation partly cut away to show the construction of the crank mechanism.
Figure 4:
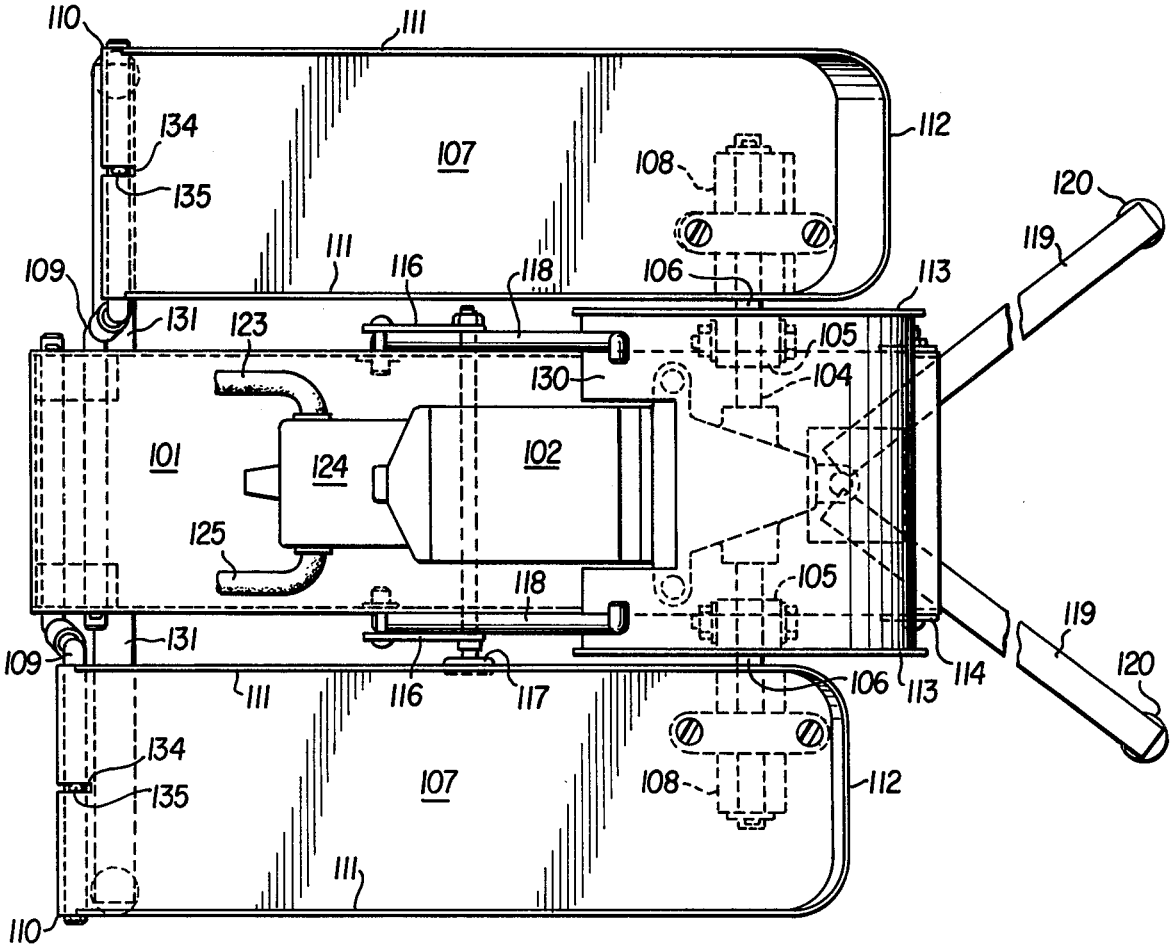
FIG. 4 is a top view of the exerciser.

An important feature of the foot and leg exerciser of this invention is the careful design for complete safety in the use of the device. The foot pads 107 are equipped with side rails 111 and heel rails 112 to keep the user's feet from sliding off. The foot pads may also be padded for further protection of the user's feet. If a foot should slip off the foot pad 107, the shield disks 113 and cover 130 will prevent the foot from becoming entangled in the mechanism. Furthermore, it will be noticed that there are no parts of the machine located where the revolving crank could pinch the user's foot if it should slip off the foot pad. The front legs 131 and rear legs 119 provide a broad stable foundation for the exerciser. However, they are located away from the cranks, and the base 101 and sub-base 115 are made narrow so that there is no part of the exerciser directly beneath the crank. Thus if the user's foot should slip off the foot pad and fall to the floor beneath the crank, the only pressure which could be exerted on the foot by the revolving crank would be a portion of the weight of the machine. Since the machine is relatively light and would have to be only partially lifted to allow the crank to revolve, even with an obstruction such as the user's foot beneath it, the force exerted on the foot would be small and certainly not enough to cause pain or injury. Finally, even if the user's foot should somehow become jammed in the mechanism, a further safety feature is provided by the method of attaching the crank arms 105 of the cranks to the crankshaft 104. As shown in FIGS. 2, 3, and 5, the crank arm 105 is not rigidly attached to the crankshaft 104, as by a pin or key, but rather is fastened by a clamp formed by a slot 132 in the crank arm 105 and a clamp screw 133. Hence, the torque of the crankshaft is transmitted to the crank only by the friction of the clamp which grips the crankshaft 104. By tightening or loosening the clamp screw 133, the friction can be adjusted so that the crankshaft will exert only enough torque on the crank to operate the exerciser normally. If a foreign object or the user's foot should become jammed in the mechanism, the clamp would simply slip on the crankshaft 104 and the force exerted on the object or foot would not be enough to cause injury or damage the machine. The fact that the user has complete control over the operation of the exerciser is also an important safety feature, for, if the user should become confused or the machine should malfunction in any way, the user can immediately stop the device by releasing the pushbutton start-stop switch. Furthermore, if the user should accidentally drop the control box the machine would stop. As pointed out above, care is also taken in the electrical power and control circuits that all parts of the exerciser are properly insulated and grounded and all circuits fused to eliminate the possibility of electric shock or other electrical malfunction.

Having now fully described the invention, it will be evident to one skilled in the art that many variations and modifications can be made thereto without departing from the spirit and scope of the invention as set forth herein.

I claim:

1. A foot and leg exerciser comprising:

a base;

at least one foot pad for supporting a foot of a person using the exerciser, said foot pad having a heel end for supporting the heel of said foot and a toe end for supporting the toe of said foot, the heel and toe ends of the foot pad defining a heel-toe axis;

a double-ended shaft having its major dimension oriented horizontally and transversely to said heel-toe axis and being rotatably journaled in a bearing means mounted on said base, said shaft having at at least on of its ends a crank comprising a crank arm and a crankpin;

the heel end of said foot pad being pivotably attached to the crankpin of said crank, and the toe end of said foot pad being pivotably supported on the upper end of a rocker arm, the lower end of said rocker arm being pivotably attached to said base; and means for rotating said shaft in said bearing means.

2. The foot and leg exerciser of claim 1 wherein said means for rotating said shaft comprises an electric motor and reduction gears.

3. The foot and leg exerciser of claim 2 wherein said electric motor is a variable speed electric motor.

4. The foot and leg exerciser of claim 2 wherein said reduction gears are contained in a housing wich is integral with said electric motor, and said housing also constitutes the bearing means for said shaft which carries said crank.

5. The foot and leg exerciser of claim 1 wherein said foot pad is provided with side rails and a heel rail.

6. The foot and leg exerciser of claim 1 wherein the radial distance between said crankpin and said crankshaft is adjustable.

7. The foot and leg exerciser of claim 1 wherein the length of said rocker arms is adjustable.

8. The foot and leg exerciser of claim 7 wherein said means for supporting said base comprises adjustable supports extending between said base and said sub-base at the ends opposite the ends at which they are pivotably attached.

9. The foot and leg exerciser of claim 8 wherein said legs and said sub-base are arranged so that no portion of said legs or said sub-base is located with respect to said cranks so that the foot of the person using the exerciser could be pinched therebetween.

10. The foot and leg exerciser of claim 1 additionally comprising a sub-base, pivotably attached to said base at the end thereof opposite to that at which the rocker arm is attached, and means for supporting said base at a chosen fixed angle to said sub-base.

11. The foot and leg exerciser of claim 7 wherein said sub base is equipped with laterally extending legs.

* * * * *

UNITED STATES PATENT AND TRADEMARK OFFICE

CERTIFICATE OF CORRECTION

PATENT NO. : 4,185,622

DATED : January 29, 1980

INVENTOR(S) : Oscar J. Swenson

It is certified that error appears in the above—identified patent and that said Letters Patent is hereby corrected as shown below:

Column 1, line 50, delete "waking" and insert --walking--;
Column 3, line 6, delete "pad, the" and insert --pad. The--;
Column 4, line 50 delete "users" and insert --user's--;
Column 6, line 38(Claim 1, line 12), delete"on" and insert --one--;
Column 6, line 53(Claim 4, line 2), delete "wich" and insert --which--;
Column 6, line 64(Claim 8, line 1) delete "7" and insert --10--;
Column 8, line 5(Claim 11, line 1) delete "7" and insert --10--;
Column 8, line 6(Claim 11, line 2) delete "sub base" and insert -- sub-base--.

Signed and Sealed this

*Sixteenth* Day of *September 1980*

[SEAL]

*Attest:*

SIDNEY A. DIAMOND

*Attesting Officer*

*Commissioner of Patents and Trademarks*